US009901219B2

(12) United States Patent
Tramontina et al.

(10) Patent No.: US 9,901,219 B2
(45) Date of Patent: Feb. 27, 2018

(54) METHOD FOR CONTROL OF AN ELECTRONIC LIQUID DISPENSER AND ASSOCIATED DISPENSER SYSTEM

(71) Applicant: Kimberly-Clark Worldwide, Inc., Neenah, WI (US)

(72) Inventors: Paul Francis Tramontina, Harleysville, PA (US); Charles Agnew Osborne, Jr., Cumming, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 15/592,648

(22) Filed: May 11, 2017

(65) Prior Publication Data

US 2017/0245698 A1 Aug. 31, 2017

Related U.S. Application Data

(62) Division of application No. 14/265,700, filed on Apr. 30, 2014, now Pat. No. 9,648,991.

(51) Int. Cl.
*A47K 5/12* (2006.01)

(52) U.S. Cl.
CPC ..... *A47K 5/1217* (2013.01); *A47K 5/1202* (2013.01); *A47K 5/1211* (2013.01)

(58) Field of Classification Search
CPC .. A47K 5/1217; A47K 5/1211; A47K 5/1202; H02P 1/04; H02P 1/18; H02P 3/00; H02P 3/08
USPC ..... 222/639, 642, 333, 63
See application file for complete search history.

(56) References Cited

U.S. PATENT DOCUMENTS

| | | | |
|---|---|---|---|
| 5,829,636 | A | 11/1998 | Vuong |
| 8,066,491 | B2 | 11/2011 | Nguyen |
| 8,646,655 | B2 | 2/2014 | Wegelin et al. |
| 8,651,329 | B2 | 2/2014 | Reynolds et al. |
| 2009/0124977 | A1 | 5/2009 | Jensen |
| 2011/0278322 | A1 | 11/2011 | Reynolds |
| 2012/0006848 | A1 | 1/2012 | Reynolds |
| 2014/0151394 | A1 | 6/2014 | Curtis |

*Primary Examiner* — Paul R Durand
*Assistant Examiner* — Robert Nichols, II
(74) *Attorney, Agent, or Firm* — Dority & Manning, P.A.

(57) ABSTRACT

A system and control method for an electronic liquid dispenser utilizes a motor to drive a pump mechanism from a home position in a dispense cycle for dispensing a metered dose of liquid from a reservoir. Upon initiation of the dispense cycle, the motor is started to operate the pump mechanism. Motor work performed by the motor during the dispense cycle is calculated as a function of motor current, motor voltage, and run time of the motor. Upon the calculated motor work exceeding a set point value during the dispense cycle, the motor is stopped and reversed to return the pump mechanism to the home position.

5 Claims, 7 Drawing Sheets

*-Prior Art-*

*-Prior Art-*

METHOD FOR CONTROL OF AN ELECTRONIC LIQUID DISPENSER AND ASSOCIATED DISPENSER SYSTEM

RELATED APPLICATION

The present application is a Divisional Application of U.S. application Ser. No. 14/265,700, filed Apr. 30, 2014.

FIELD OF THE INVENTION

The present invention relates generally to the field of electronic dispensers, such as soap dispensers, and more particularly to a dispenser system and associated control method wherein the actuating motor in the dispenser is stopped and reversed under certain abnormal operating conditions.

BACKGROUND

Electronic dispensers for dispensing any manner of metered doses of a liquid are well known in the art. Such dispensers are commonly used to dispense soap, lotions, disinfectants, and the like in public facilities, especially restaurants, hospitals, businesses, and so forth. These dispensers are typically "hands-free" systems wherein a sensor detects the presence of person's hands adjacent the dispenser and, in response, a controller causes a motor to automatically start and engage a pump actuating mechanism to dispense a metered dose of the liquid into the person's hands. In normal operations, the motor and pump actuating mechanism operate over a cycle wherein the motor is de-energized when the pump actuating mechanism (or an associated linkage or other member that moves with the pump actuator) returns to a "home" position that is detected by a sensor in communication with the controller. The "home" position is the closed position of the pump actuating mechanism wherein the liquid is prevented from draining or leaking from the reservoir.

An undesirable condition results, however, when any one or combination of malfunctions result in a motor jam or overrun condition, or a jam of the pump actuating mechanism in mid-cycle. When this happens, liquid may leak or even drain completely from the reservoir. For example, if the sensor that detects the home position of the pump actuating mechanism fails, the motor will continue to run and cycle the pump actuating mechanism. In another malfunction, the motor or moving members of the pump actuating mechanism may become jammed by debris or other obstruction during a dispense cycle, wherein the liquid is then free to flow from the reservoir through the open pump mechanism.

Proposals have been suggested to address (at least in part) the problem discussed above. For example, U.S. Pat. No. 8,646,655 describes a control method for a liquid soap dispenser wherein a stalled pump mechanism is reset to the "loading" position by reversing the pump motor upon detection that the pump actuator is still dispensing after a defined time period as measured by a run timer. A sensor is used to determine when the pump mechanism has returned to the loading position. Thus, this control method is premised on a maximum run time function of the motor, which times the actuation of the pump, to detect whether a stall of the pump mechanism has occurred.

U.S. Pat. No. 8,651,329 describes another control method for a liquid soap dispenser by wherein a stalled pump mechanism is reset to the loading position by reversing the pump motor. With this method, motor current is monitored during the dispense cycle and the motor is reversed if the current exceeds a predetermined level. Reversal of the motor is stopped when a sensor detects that the pump actuator has returned to the loading position.

The present invention provides an alternative solution whereby the control method considers multiple variables to determine a stall or jam of the pump mechanism before reversing the motor pump to return the pump mechanism to its home position.

SUMMARY OF THE INVENTION

Objects and advantages of the invention will be set forth in part in the following description, or may be obvious from the description, or may be learned through practice of the invention.

In certain aspects, the present invention provides a control method for an electronic liquid dispenser, wherein the liquid dispenser utilizes a motor powered by a voltage source to drive a pump mechanism from a home position in a dispense cycle for dispensing a metered dose of liquid from a reservoir. It should be appreciated that the control methodology is not limited to any particular type or configuration of electronic dispenser. Conventional electronic dispensers that detect the presence of a user with a sensor (e.g., an IR or capacitive sensor) and dispense a metered dose of liquid (e.g., soap, disinfectant, and the like) are well known in the art. The present invention has utility and is applicable to these various conventional dispensers, as well as to any new types of electronic dispensers that may be developed in the future.

The method includes starting the motor to operate the pump mechanism upon initiation of the dispense cycle. In operation, the motor performs "motor work" as a function of motor current/motor voltage, or motor voltage/motor resistance, and run time of the motor. Motor work is monitored as a more accurate and dynamic indication of a failed, stalled, or jammed motor. At one or more times during the dispense cycle, the motor work is calculated by a controller and, upon the calculated motor work exceeding a set point value during the dispense cycle, the controller stops and reverses the motor to return the pump mechanism to the home position.

It should be appreciated that the motor work will vary between different types of pump mechanisms, and that the present methodology is not limited to any particular type of pump mechanism. For example, a cam driven pump mechanism may generate a different work profile during a normal dispense cycle as compared to a piston-driven (or other type) of pump mechanism.

The set point motor work value may remain the same throughout the dispense cycle or, in certain embodiments, the set point value may change during the dispense cycle depending on whether or not the particular type of pump mechanism generates a varying motor work profile during a normal dispense cycle.

In one embodiment, the motor work is calculated immediately after start of the motor in order to detect an initial jam of the motor and reverse the motor. The set point motor work value immediately after start of the motor is set to detect such an initial jam of the motor.

As mentioned, motor work may be calculated essentially continuously or at various times throughout the dispense cycle. In a particular embodiment, the pump mechanism generates a normal, repeatable motor current profile during a normal dispense cycle, the method further comprising monitoring and detecting one or more deviations of motor current from the normal current profile. When such deviations occur, motor work is calculated and the motor is reversed if the calculated motor work exceeds the set point value.

For example, the normal motor current profile may include an increase in motor current at the home position of the pump mechanism (e.g., as an indication that the pump mechanism has been driven against a hard stop). The method may include detecting the increase in motor current at the end of the dispense cycle before stopping the motor. If the increase is not detected, calculated work will eventually exceed the set point value and the motor will be reversed.

Similarly, the normal motor current profile may include an initial increase and subsequent decrease in motor current during the dispense cycle, particularly for a cam-driven pump mechanism, with the method further detecting the decrease in motor current before the calculated motor work exceeds the set point value.

Likewise, the normal motor voltage profile may include a decrease in motor voltage at the home position of the pump mechanism (e.g., as an indication that the pump mechanism has been driven against a hard stop). The method may include detecting the decrease in motor voltage at the end of the dispense cycle before stopping the motor. If the decrease is not detected, calculated work will eventually exceed the set point value and the motor will be reversed.

Similarly, the normal motor voltage profile may include an initial decrease and subsequent increase in motor voltage during the dispense cycle, particularly for a cam-driven pump mechanism, with the method further detecting the increase in motor voltage before the calculated motor work exceeds the set point value.

The method may further include monitoring motor characteristics after the reversal command. For example, after the motor is reversed, motor current may be monitored for an increase in motor current before stopping the motor, the increase in motor current being an indication that the pump mechanism has returned to the home position. Before the increase in motor current is detected, motor current may be monitored for steady or decreasing current for a defined time period. Likewise, after the motor is reversed, motor voltage may be monitored for a decrease before stopping the motor, the decrease in motor voltage being an indication that the pump mechanism has returned to the home position. Before the decrease in motor voltage is detected, motor voltage may be monitored for steady or increasing voltage for a defined time period.

The present invention also encompasses any manner of electronic liquid dispenser incorporating the control aspects discussed above. For example, an electronic liquid dispenser according to the invention includes a reservoir for storing a liquid to be dispensed in metered doses from the dispenser, and a pump mechanism operably configured with the reservoir. A motor drives the pump mechanism from a home position in a dispense cycle for dispensing the metered doses of liquid from the reservoir, the motor powered by a voltage source. A sensor (e.g., an IR or capacitive sensor) is configured to detect the presence of a user and initiate the dispense cycle. A controller is connected to the sensor and motor, as well as to a current sensor and a voltage sensor. The controller is configured to calculate motor work being performed by the motor during the dispense cycle as a function of motor current and motor voltage, or motor voltage and motor resistance, and run time of the motor. Upon the calculated motor work exceeding a set point value during the dispense cycle, the controller stops and reverses the motor to return the pump mechanism to the home position.

DETAILED DESCRIPTION OF THE INVENTION

Figure 1:
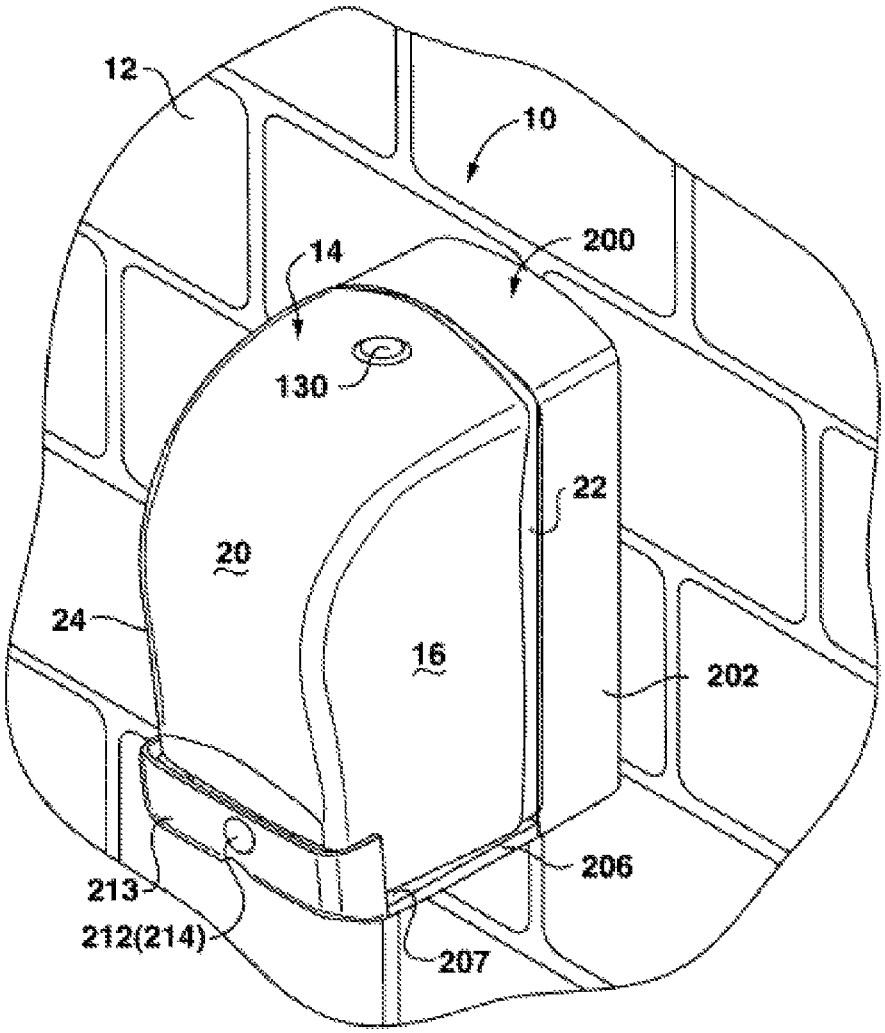
FIG. 1 is a perspective view of a conventional electronic liquid soap dispenser that may incorporate aspects of the present invention.

Reference will now be made in detail to one or more embodiments of the invention, examples of the invention, examples of which are illustrated in the drawings. Each example and embodiment is provided by way of explanation of the invention, and is not meant as a limitation of the invention. For example, features illustrated or described as part of one embodiment may be used with another embodiment to yield still a further embodiment. It is intended that the invention include these and other modifications and variations as coming within the scope and spirit of the invention.

As discussed, the present invention relates to control methods for electronic liquid dispensers, and dispensers that incorporate such control methods. Although having particular usefulness as a liquid soap dispenser, the dispenser according to the invention is not limited to a liquid soap dispenser and may be utilized in any application wherein it is desired to dispense metered doses of a viscous liquid, such as disinfectant, moisturizer, sanitizer, and so forth. The liquid dispenser will be described herein with reference to a soap dispenser for ease of explanation. The present invention is not limited to any particular type or configuration of dispenser, so long as the dispenser has the structural and control functionalities to incorporate the aspects of the invention. For sake of illustration only, FIGS. 1 and 2 are provided to illustrate a type of conventional dispenser that may utilize aspects of the present invention.

Figure 2:
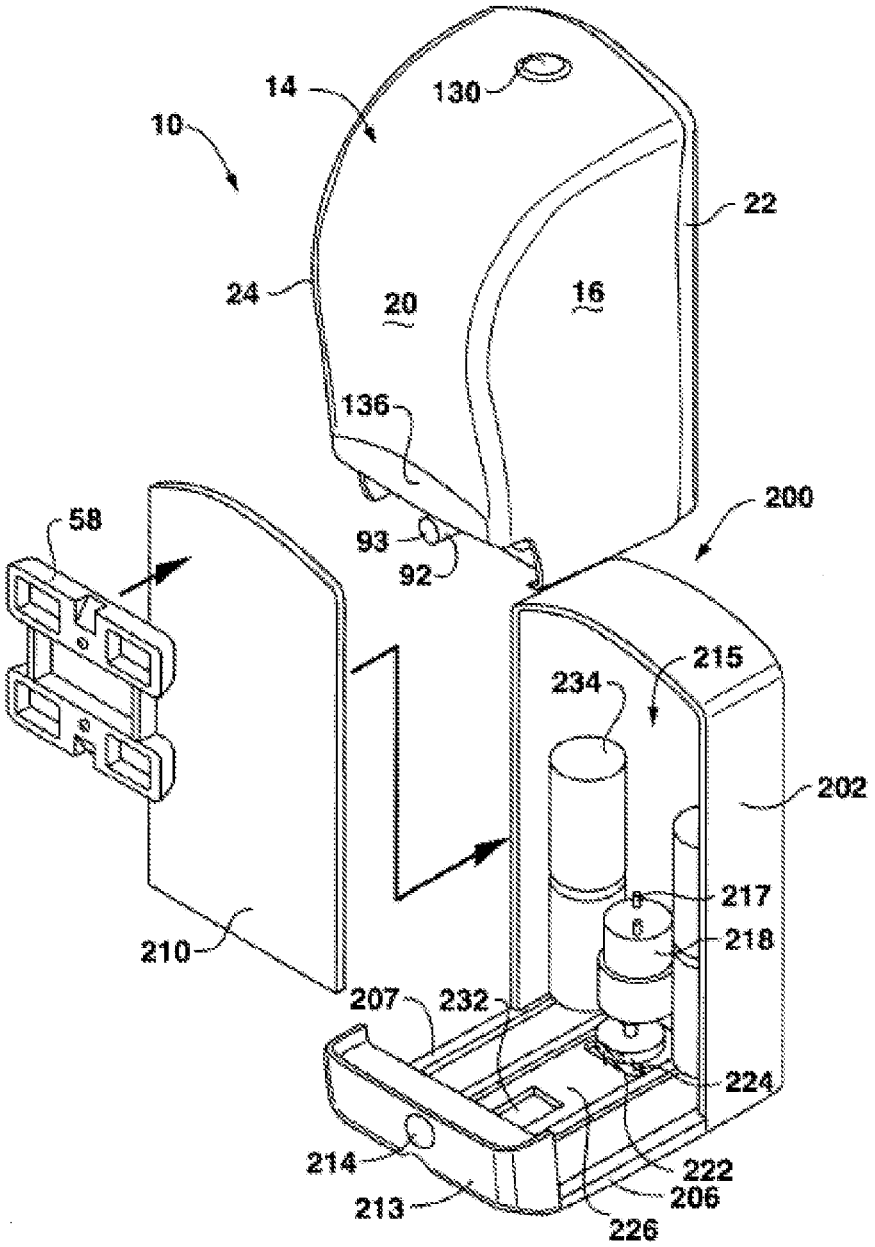
FIG. 2 is a perspective component view of the conventional dispenser of FIG. 1.

A liquid dispenser 10 is illustrated in FIGS. 1 and 2 as a liquid soap dispenser, which is a particularly useful embodiment of the present invention. The dispenser 10 includes any suitable housing structure 14. The housing 14 may contain a back side, side walls or members 16, and a front side 20. The housing 14 can take on any desired configuration and be formed from any number of components. In the illustrated embodiment, the housing 14 includes a front component 24 and a back component 22. The front and back components may be separately manufactured and permanently joined. The components may be manufactured from any desired material.

The housing 14 defines an internal liquid reservoir within the internal volume thereof that is filled with a liquid, such as soap, through port 130, which may also act as a vent. In the illustrated embodiment, the liquid reservoir includes essentially the entire volume defined by the front component 24 and back component 22. Although not illustrated, it should be understood that any number of internal structural members, such as baffles or the like, may be included within the reservoir. In this particular embodiment, the housing 14 thus also serves as a closed or sealed reservoir that cannot be opened by the maintenance technician. A desired amount of viscous liquid, for example soap, is preloaded into the housing 14 prior to the housing being delivered to its point of use. In alternate embodiments of soap dispensers, the reservoir may be defined by soap-filled bags, bottles, or other containers that are inserted into the dispenser housing.

In the illustrated dispenser 10, the pump mechanism is contained wholly within the housing 14, and may include a cylinder 92 that is slidable within a chamber, wherein the volume of the chamber determines the metered dose of liquid dispensed upon each actuation of the pump. The chamber may be formed by any internal structure of the housing 14. The cylinder 92 includes a delivery channel that terminates at a dispensing orifice defined in the front end face 93 of the cylinder 92.

In other embodiments, the pump mechanism may be separately contained within the dispenser housing, wherein the reservoir mates with the pump mechanism upon insertion of the reservoir into the pump housing.

Any manner of suitable mounting assembly 200 is provided for mounting the dispenser (particularly the housing 14) to a supporting wall structure 12. In the illustrated embodiment, the mounting assembly 200 includes an enclosed back unit 202 that is mountable against the supporting wall structure 12 by any conventional means, such as screws, adhesives, and the like. Various components of the electronic actuating mechanism may be housed in the back unit 202. As seen in FIG. 2, the back unit 202 may include a wall 210 to which is attached the bracket 58. The housing 14 is attachable to the bracket 58, as described above, such that the back 18 of the housing 14 is flush against the wall 210, as in the configuration of FIG. 1. The bracket 58 may be mounted to the wall 210, or formed integrally therewith.

The mounting assembly 200 may include a base unit 206 that can be attached to, or formed integral with, the back unit 202. The base unit 206 is disposed under the housing 14 and may support a portion of the weight of the housing. For example, the housing 14 may rest at least partially on support members 207 once attached to the back unit 202, as seen in FIG. 1. Alternately, the housing 14 may be supported entirely on the wall 210 above the base unit 206. The base unit 206 may include an upturned front member 213 that covers components of a pump actuator, and provides an overall aesthetically pleasing profile to the combined housing 14 and mounting assembly 200, as particularly seen in FIG. 1.

An electronic actuating mechanism 215 provided to drive the pump mechanism may be housed in one of the units of the mounting assembly. This mechanism may include a motor driven actuator 226 that engages with the pump mechanism within the housing upon insertion of the housing 14 into the mounting assembly 200. A motor 218, such as a DC motor, and associated power supply circuitry 217 are also carried by the mounting assembly 200. The motor 218 is in driving engagement with the actuator 216. Power for the motor 218 and associated circuitry may be supplied by one or more replaceable batteries 234 also carried by the mounting assembly, or may be a direct hard-wire supply, for example DC current converted from a building's AC system. For sake of clarity, the wiring and circuitry components are not illustrated in the various views of the dispenser. Such connections are, however, a matter of simple design choice for those skilled in the art and need not be described in detail herein.

In the illustrated embodiments, the motor driven actuator 215 includes a member that is slidable in a horizontal path to engage and move the pump cylinder 92 from a resting or "home" position to a dispensing position within the pump chamber (within the housing 14). The cylinder 92 may be engaged by the actuator 226 so as to be driven throughout the dispense cycle, including return of the cylinder to its home position.

Motive force from the motor 218 may be transferred to the actuator 226 in any number of suitable embodiments. In the illustrated embodiments, the motor 218 includes an off-center drive cam 222 engaged within an elongated cam surface 224, such as an elongated slot, defined in the motor driven actuator 226. This eccentric or off-center cam arrangement converts rotational movement of the motor shaft to linear movement of the motor driven actuator 226, which in turn engages and moves the pump cylinder 92 in a linear path from its rest position to a dispensing position wherein a metered dose of the viscous liquid is expelled from the pump chamber. Operation of the actuator 226 is hidden from view by the upturned wall 213 of the base unit 206. An opening 232 (i.e., an elongated slot) may be defined in the actuator 226 proximate to the front end that is aligned with the delivery end of the pump cylinder 92 such that the metered dose of liquid is dispensed through the opening 232.

Operation of the electronic dispenser may be initiated manually or automatically. For example, for manual actuation, a push-button 212 or similar device may be provided with the mounting assembly 200 wherein a user initiates a dispensing sequence by manually pushing the button 212 or otherwise actuating the manual device. This manual actuation in turn results in an electronic motor driven dispensing cycle as described above. In an alternate embodiment, a sensor 214 may be provided and integrated with the control circuitry for automatic initiation of the dispensing sequence. The sensor 214 may be, for example, a heat sensor, motion sensor, or any one or combination of sensors widely known and used for detecting the presence of a person in relatively close proximity to the dispenser 10.

Figure 3:
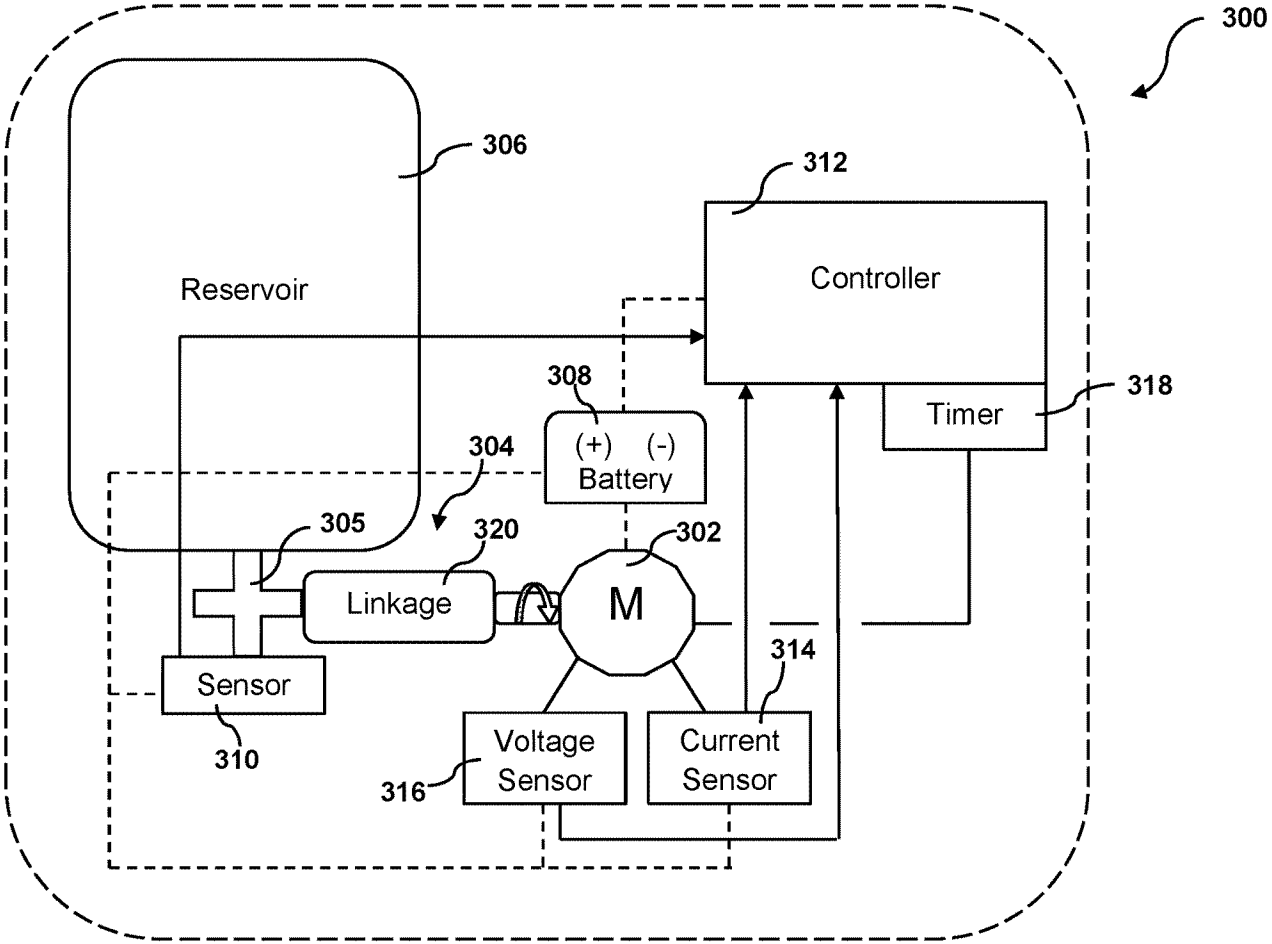
FIG. 3 is a block diagram of a dispenser in accordance with aspects of the invention.

FIG. 3 is a block diagram of an exemplary electronic dispenser that may be used to practice aspects of the current invention. The dispenser 300 includes a reservoir or bottle 306 that includes a liquid (e.g., soap) to be dispensed in metered doses. A motor 302 drives a pump mechanism 304 in response to a dispense command issued from a controller 312. The pump mechanism 304 may be variously configured within the scope and spirit of the invention. For example, any manner of gearing/linkage 320 may be configured to convert rotational movement of the motor 302 into any other type of motion needed to drive a pump 305, which may be, for example, reciprocating linear motion. In a particular embodiment, the pump 305 may be cam driven, wherein the linkage 320 includes a suitable cam arrangement. As discussed above, the pump 305 may be an integral component of the reservoir 306 such that the pump 305 is replaced with the reservoir 306. In an alternate embodiment, the pump 305 may be a permanent component of the dispenser housing that mates with the reservoir 306 upon installation of the reservoir in the dispenser housing. It should be appreciated that the present methodology and dispenser system is not limited to any particular type of motor and pump mechanism configuration.

Still referring to FIG. 3, the dispenser 300 includes a sensor 310 in communication with the controller 312 for detecting the presence of a user adjacent to the dispenser 300, wherein the controller 312 then issues a dispense command. Such sensors 310 are well known in the art, and may include any manner of suitable active or passive proximity-type of sensor typically used in electronic dispensers. The invention is not limited to any particular type of sensor.

A voltage source, such as a battery 308, supplies power to the various electronic components of the dispenser 300. In an alternate embodiment, the dispenser 300 may be hard-wired to a structure's power system.

Any suitable voltage sensor 316 and current sensor 314 are provided for sensing the voltage and current draw states of the motor 302 during the dispense cycle. The sensors 316 and 314 are in communication with the controller 312. It should be appreciated that, in an embodiment wherein motor work is calculated as a function of motor voltage and known motor winding resistance, the current sensor 316 is not necessary.

Any manner of suitable timing device or circuit 318 is provided for timing the run time of the motor 302 throughout the dispense cycle.

It should be noted in FIG. 3 that the dispenser 300 does not utilize any type of mechanical or electronic switch to determine if or when the pump mechanism 304 has returned to its "home" or start position. For example, the dispenser 300 does not utilize a magnetic contact to convey to the controller 312 that a component of the pump 305 or linkage 320 has reached a position that is indicative of the home position of the pump mechanism 304. Thus, the control methodology and system of the present invention are not prone to failures of such switches or contacts.

Figure 4A:
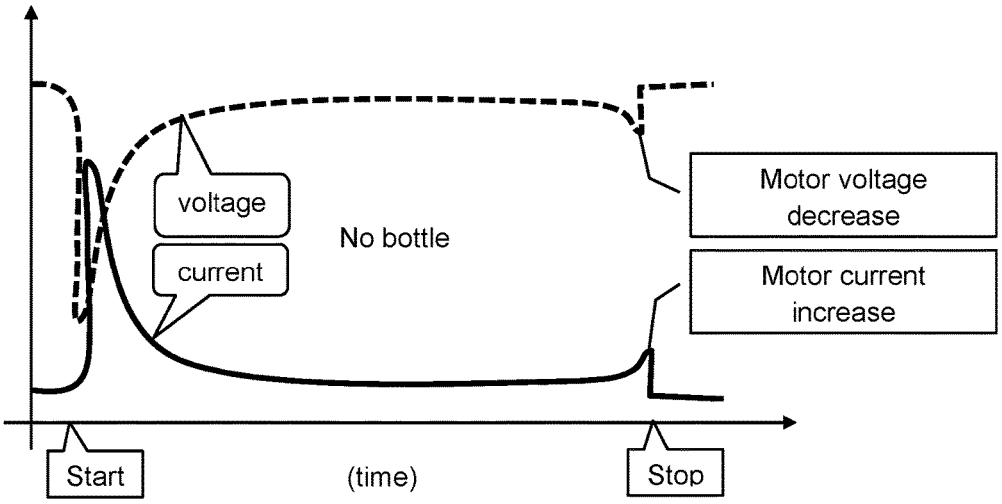
FIG. 4A is a current and voltage over time graph of an exemplary electronic dispenser over the course of a dispense cycle without a reservoir bottle inserted in the dispenser.

As discussed above, the present dispenser control methodology relies in part of the fact that the motor 302 will generate a "normal" electrical profile over the course of the dispense cycle as a function of the power required by the motor to move the pump mechanism 304 through a complete cycle. This profile may be a voltage or current profile. FIG. 4A is a current and voltage over time graph of an exemplary motor/pump mechanism configuration without a reservoir bottle installed in the dispenser. Thus, the current graph over time illustrates the power output of the motor 302 at a given supply voltage required to cycle the pump mechanism 304 without resistance to fluid flow through the pump mechanism or other frictional forces from the reservoir 306. Likewise, the voltage graph over time also depicts the power output of the motor 302 at a given resistance (predetermined or rated) of the motor required to cycle the pump mechanism 304 without resistance to fluid flow through the pump mechanism or other frictional forces from the reservoir 306. FIG. 4A depicts an initial current spike and initial voltage drop at the start of the dispense cycle that reflects the starting characteristics of the motor. The current tapers back down and voltage increases to nominal levels throughout the dispense sequence of the pump mechanism until the end of the cycle when the pump mechanism hits a hard stop at the home position of the pump (or linkage), which is reflected by a slight increase in current and slight decrease in voltage (due to resistance of the pump mechanism at the hard stop) before the motor is stopped at the end of the dispense cycle.

Figure 4B:
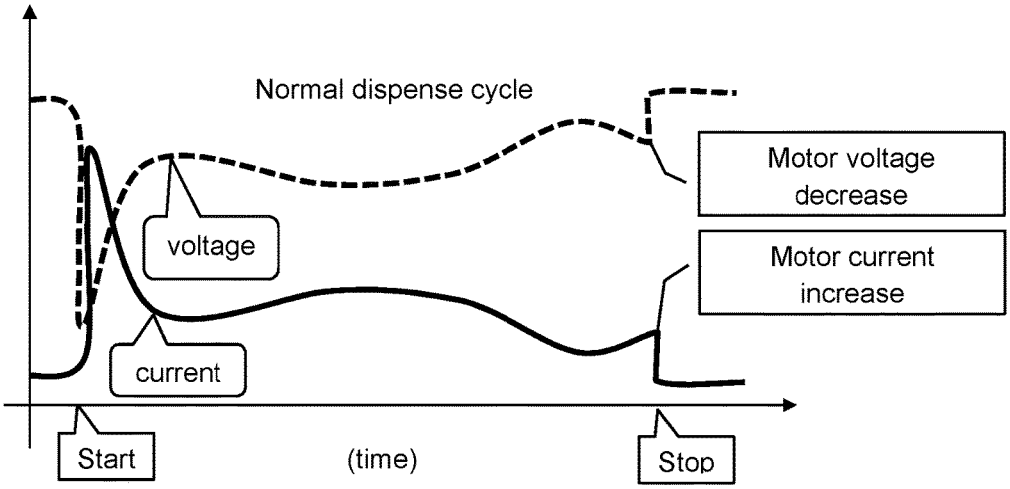
FIG. 4B is a current and voltage over time graph of an exemplary electronic dispenser over the course of a normal dispense cycle with a reservoir bottle inserted in the dispenser.

FIG. 4B illustrates a current and voltage over time graph for the same type of dispenser over the course of a normal dispense cycle wherein the pump mechanism 304 dispenses a metered dose of liquid from a reservoir 306. After the initial current spike and voltage drop, the respective graphs follow a somewhat bell-curve shape that reflects the power output of the motor 302 required to move the pump mechanism and dispense the metered fluid dose. Again, at the end of the cycle, current increases slightly and voltage decreases slightly as the pump mechanism returns to the home position before the motor is stopped.

It should be appreciated that the "normal" current and voltage profiles in FIG. 4B will differ between various motor/pump configurations, and that the profiles in FIG. 4B are for discussion purposes only. The point of consideration is that, under normal dispensing conditions and voltage supply to the motor, a given motor/pump configuration will generate a repeatable current and voltage profile from which motor work can be calculated over the course of the dispense cycle. With a normal baseline profile, deviations in motor work that occur in abnormal (e.g., jam) conditions can be readily calculated.

Figure 4C:
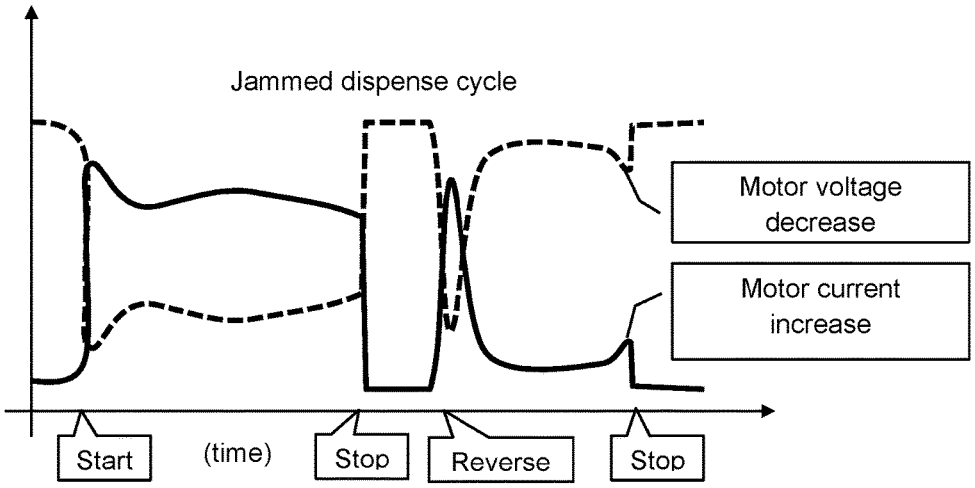
FIG. 4C is a current and voltage over time graph of an exemplary electronic dispenser over the course of a jammed dispense cycle.
Figure 5:
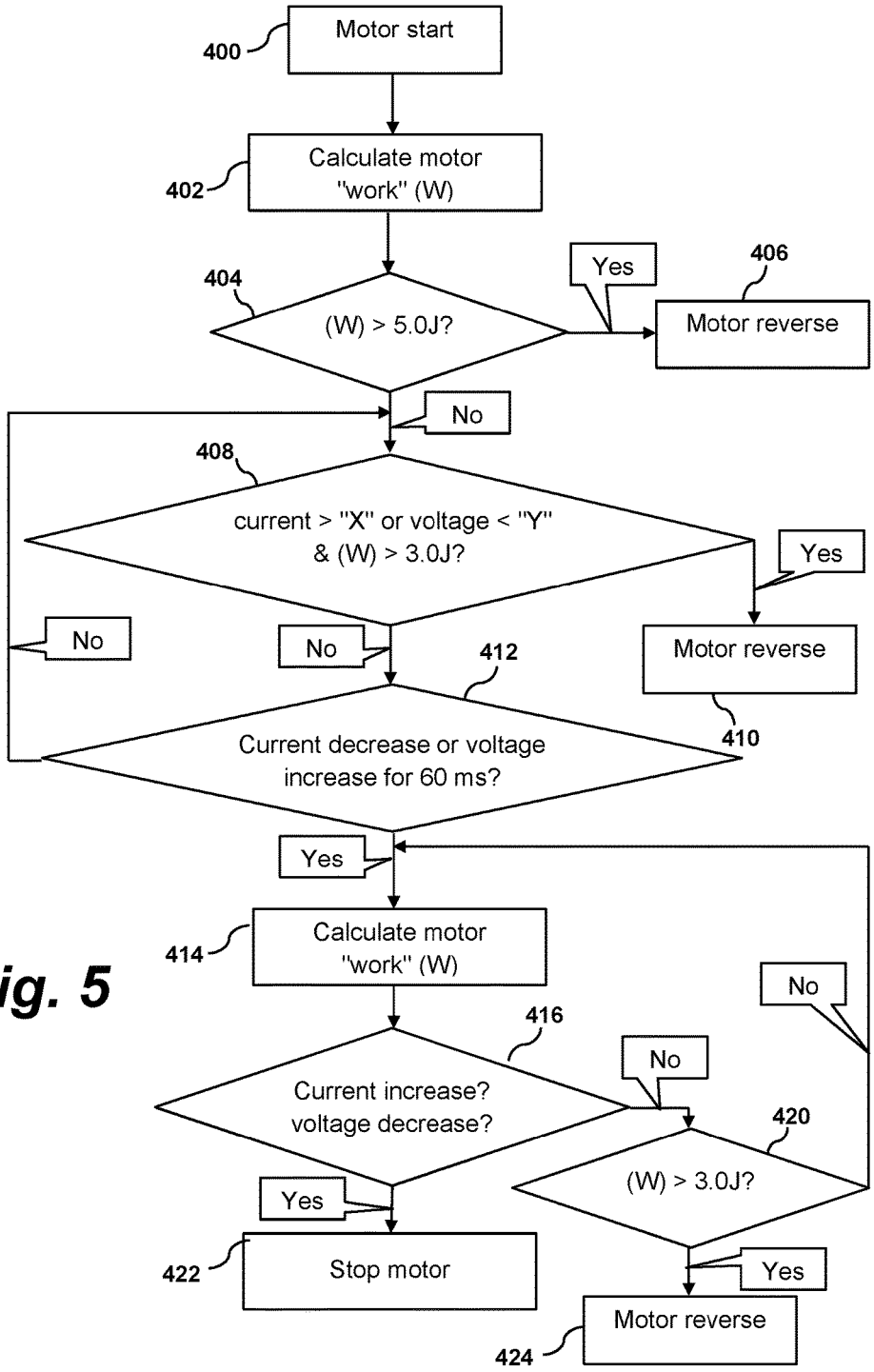
FIG. 5 is flow chart of a dispense cycle in an electronic dispenser in accordance with aspects of the invention.

FIG. 4C illustrates a current and voltage over time graph during a jammed dispense cycle wherein an abnormal condition in the pump mechanism 304 results in the motor fighting against a jam of the pump or linkage. After the initial starting current spike and voltage drop, current remains high and voltage remains low as the motor generates more power against the jam condition. At a certain time, the motor work setpoint value is exceeded and the motor is commanded to stop and then to subsequently reverse. The reverse command generates another starting current spike and voltage drop followed by a tapering of current and increase in voltage. As the pump or linkage returns to the home position in the reverse direction, a slight current increase and voltage decrease are detected before the motor is stopped. FIG. 5 is a flowchart of an exemplary methodology in accordance with aspects of the invention. The method includes starting the motor at step 400 to operate the pump mechanism upon initiation of the dispense cycle. This command is generated by the controller in response to a manual operation (e.g., pushes a dispense button) taken by a user at the dispenser, or is generated automatically by the controller in response to detection of the user by a sensor 310 (FIG. 3). As discussed above, in operation, the motor performs "motor work" as a function of motor current and motor voltage, or motor voltage and motor resistance, and run time of the motor. Work may be calculated as:

$$\text{Work}=(\text{Current})\times(\text{Voltage})\times(\text{run time});$$

or $$\text{Work}=(\text{Voltage}/\text{Resistance})\times(\text{run time})$$

Motor work is monitored as a more accurate and dynamic indication of a failed, stalled, or jammed motor. At one or more times during the dispense cycle, the motor work is calculated by the controller and, upon the calculated motor work exceeding a set point value during the dispense cycle, the controller stops and reverses the motor to return the pump mechanism to the home position. The set point motor work value may remain the same throughout the dispense cycle or, in certain embodiments, the set point value may change during the dispense cycle depending on whether or not the particular type of pump mechanism generates a varying motor work profile during a normal dispense cycle.

At step 402, motor work is calculated essentially immediately after start of the motor in order to detect an initial jam of the motor and reverse the motor, as would be the situation depicted in FIG. 4C. The set point motor work value immediately after start of the motor is set to detect such an initial jam of the motor. In FIG. 5, this value is stated as "5.0 Joules" for illustration only.

At step 404, the calculated motor work is compared to the set point value and if this value is exceeded, the motor is stopped and reversed at step 406.

If the calculated motor work is less than the initial set point value, then a comparison of motor current and calculated work is done at step 408. If current or voltage exceed a certain value and work eventually exceeds another set point value, then a condition may exist wherein a weak voltage source (e.g., weak batteries) are present and the motor cannot overcome the spring or frictional forces of the pump mechanism. If this situation exists, then the motor is stopped and reversed at step 410.

If the motor is not reversed in step 408, the control method then continues to essentially monitor for a normal work profile (as evidenced by the current or voltage profiles). For example, at step 412, current is monitored for a decrease, or voltage is monitored for an increase, over a defined period of time, which reflects that required power has peaked and that the motor is returning the pump mechanism to the home position. If this condition is not met, the system returns to step 408 and eventually motor work will exceed the set point value defined at step 408.

If the conditions at step 412 are satisfied, motor work is again calculated at step 414 and current is monitored at step 416 for an increase that is indicative of the pump mechanism reaching the home position. If the current increase or voltage decrease is detected, then the dispense cycle is over and the motor is stopped at step 422.

If the current increase is not detected at step 416, then calculated work is compared to a set point value at step 420. If this value is exceeded before the current increase or voltage decrease is detected, the pump mechanism has failed to seat or reach the home position and the motor is stopped and reversed at step 424.

Figure 6:
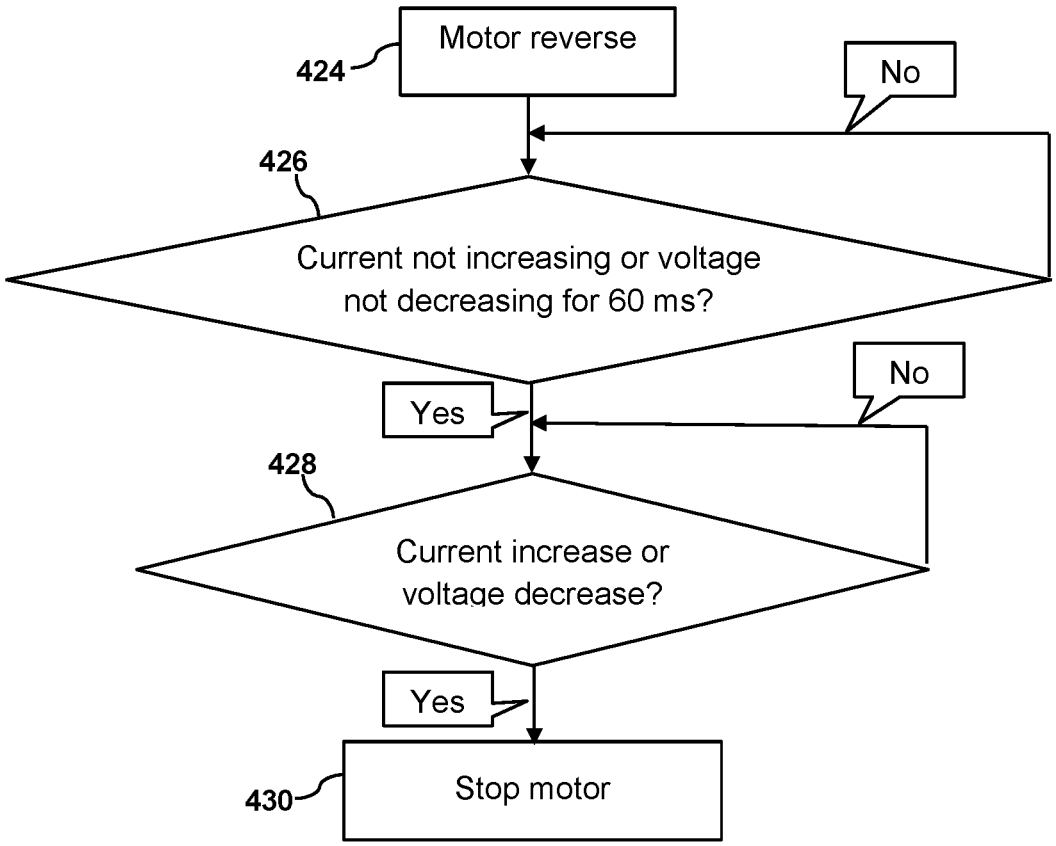
FIG. 6 is a flow chart of a dispense cycle after a motor reverse command is given to the motor.

FIG. 6 is a flow chart depicting monitoring steps that may take place after a motor stop and reverse command is issued by the controller at any point 424 in the process of FIG. 5. At step 426, current or voltage are monitored to ensure that power is steady or decreasing for a defined period of time. If this condition is satisfied, current is monitored at step 428 for the slight increase, or voltage is monitored for a slight decrease, that is indicative of the pump mechanism reaching the home position, and the motor is stopped at step 430.

While the present invention has been described in connection with certain preferred embodiments it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. An electronic liquid dispenser, comprising:

a reservoir for storing a liquid to be dispensed in metered doses from the dispenser;

a pump mechanism operably configured with the reservoir;

a motor to drive the pump mechanism from a home position in a dispense cycle for dispensing the metered doses of liquid from the reservoir, the motor powered by a voltage source;

a sensor configured to detect the presence of a user and initiate the dispense cycle;

a controller connected to the sensor and motor;

at least one of a current sensor or a voltage sensor connected to the controller, wherein the controller is configured to:

upon initiation of the dispense cycle, calculate motor work performed by the motor immediately after motor start;

upon the calculated motor work immediately after motor start exceeding a first set point work value during initiation of the dispense cycle, stopping and reversing the motor to return the pump mechanism to the home position;

during the dispense cycle, separately detecting motor voltage and motor current; and upon the calculated motor work being greater than a second set point work value and less than the first set point work value, stopping and reversing the motor to return the pump mechanism to the home position when (a) detected voltage falls below a set point voltage value or (b) detected current exceeds a set point current value.

2. The electronic liquid dispenser as in claim 1, wherein the first set point work value immediately after start of the motor is defined to detect an initial jam of the motor.

3. The electronic liquid dispenser as in claim 1, wherein the pump mechanism generates a normal, repeatable motor current profile or motor voltage profile during a normal dispense cycle, the controller monitoring and detecting one or more deviations from the normal current or voltage profile and calculating motor work upon detection of such deviations.

4. The electronic liquid dispenser as in claim 3, wherein the controller detects an electrical characteristic of the motor at the home position of the pump mechanism prior to stopping the motor at the end of the dispense cycle, thereby eliminating need for a separate home position sensor in the dispenser.

5. The electronic liquid dispenser as in claim 4, wherein the electrical characteristic of the motor is a voltage decrease or a current increase when the pump mechanism reaches the home position.

* * * * *